US005655916A

United States Patent [19]

Hayashi

[11] Patent Number: 5,655,916

[45] Date of Patent: Aug. 12, 1997

[54] SPRING-BIASED ELECTRICAL CONNECTOR

[75] Inventor: Hiroyuki Hayashi, Yokkaichi, Japan

[73] Assignee: Sumitomo Wiring Systems, Ltd., Mie, Japan

[21] Appl. No.: 415,151

[22] Filed: Mar. 31, 1995

Related U.S. Application Data

[63] Continuation of Ser. No. 230,795, Apr. 21, 1994, abandoned.

[30] Foreign Application Priority Data

Apr. 27, 1993 [JP] Japan ..... 5-125121

[51] Int. Cl.[6] ..... H01R 13/62

[52] U.S. Cl. ..... 439/155; 439/153

[58] Field of Search ..... 439/350–358, 439/700, 824, 307–322, 923, 324

[56] References Cited

U.S. PATENT DOCUMENTS

| | | | |
|---|---|---|---|
| 2,226,869 | 12/1940 | Martinek | 439/824 |
| 2,668,888 | 2/1954 | Johnson | 439/824 |
| 2,986,675 | 5/1961 | Burson et al. | 439/56 |
| 3,171,183 | 3/1965 | Johnston | 439/824 |
| 3,273,106 | 9/1966 | Martin | 439/700 |
| 4,265,503 | 5/1981 | Baur | 439/352 |
| 4,329,552 | 5/1982 | Mcconnell | 439/824 |
| 4,809,143 | 2/1989 | Feger et al. | 439/56 |
| 4,906,210 | 3/1990 | McNiel | 439/923 |
| 4,915,648 | 4/1990 | Takase et al. . | |
| 4,927,382 | 5/1990 | Huber . | |
| 5,082,455 | 1/1992 | Wei . | |

FOREIGN PATENT DOCUMENTS

| | | |
|---|---|---|
| 0314949 | 5/1989 | European Pat. Off. . |
| 3906667 | 9/1989 | Germany . |
| 4-124774 | 11/1992 | Japan . |
| 4-334908 | 11/1992 | Japan . |
| 2248732 | 4/1992 | United Kingdom . |

*Primary Examiner*—David L. Pirlot
*Attorney, Agent, or Firm*—Oliff & Berridge

[57] ABSTRACT

An abutment rib of a first connector portion compresses a coil spring, mounted in a second connector portion. If the connector is released prior to complete and proper electrical connection, the connector portions are moved away from each other to visibly and clearly indicate an incomplete or inadequate connection. When the connector mechanism is properly fitted, retaining projections of lock arms positively engage retaining holes in a hood portion, thereby maintaining the connector portions in a locked and properly fitted, electrically connected condition against the bias of the coil spring urging the abutment rib. Therefore, only when the connectors are properly and completely fitted together, and are prevented from withdrawal, is a proper electrical connection indicated and achieved. The connector mechanism clearly indicates an electrically-connected condition, thereby preventing a half-connected condition.

18 Claims, 4 Drawing Sheets

SPRING-BIASED ELECTRICAL CONNECTOR

This is a Continuation of application Ser. No. 08/230,795 filed Apr. 21, 1994, now abandoned.

BACKGROUND OF THE INVENTION

This invention relates to a connector, and more particularly to a connector having a mechanism for maintaining a fitted condition.

With reference to FIG. 4, one related art connector 1 has external threads 2 formed on an outer peripheral surface of an end portion thereof, and the other connector 3 has at its outer periphery a rotation ring 5 having internal threads 4 threadedly engageable with the external threads 2.

The two connectors 1 and 3 are disposed in opposed relation to each other, and the rotation ring 5 is rotated to threadedly engage the internal threads 4 with the external threads 2 so that the connectors 1 and 3 are moved toward each other and are electrically connected together. By rotating the rotation ring 5 in the opposite direction, the connectors 1 and 3 are disengaged from each other, thereby breaking the electrical connection.

In the above conventional connector, the electrical connection and disconnection are achieved by rotating the rotation ring 5. However, the electrically-connected condition cannot be easily verified merely by rotating the rotation ring 5, and therefore there has been encountered a problem that a half-connected condition in which the connection is incomplete can occur.

SUMMARY OF THE INVENTION

An object of the invention is to provide a connector of the type in which an electrically-connected condition can be clearly verified, thus substantially eliminating a half-connected condition.

Another object of the invention is to provide a positive locking mechanism for connector.

Yet another object is to provide a clearly visible indication of an incomplete or improper electrical connection.

The above objects of the present invention have been achieved by a connector wherein one of a pair of connector portions is inserted into and engaged with the other connector portion; a spring mechanism urges the two connector portions away from each other during the insertion, and a lock mechanism retains the two connector portions against the action of the spring mechanism when the two connector portions are moved close to a proper fitted position.

BRIEF DESCRIPTION OF THE DRAWINGS

The invention will be described in detail with reference to the drawings, wherein.

DETAILED DESCRIPTION OF PREFERRED EMBODIMENTS

One preferred embodiment of the present invention will now be described with reference to the drawings. In this embodiment, the invention is applied to a connector mechanism for charging an electric car, with one connector portion fixed to a body of the car and the other connector portion connected to a distal end of a charging cable connected to a charger.

Figure 1:
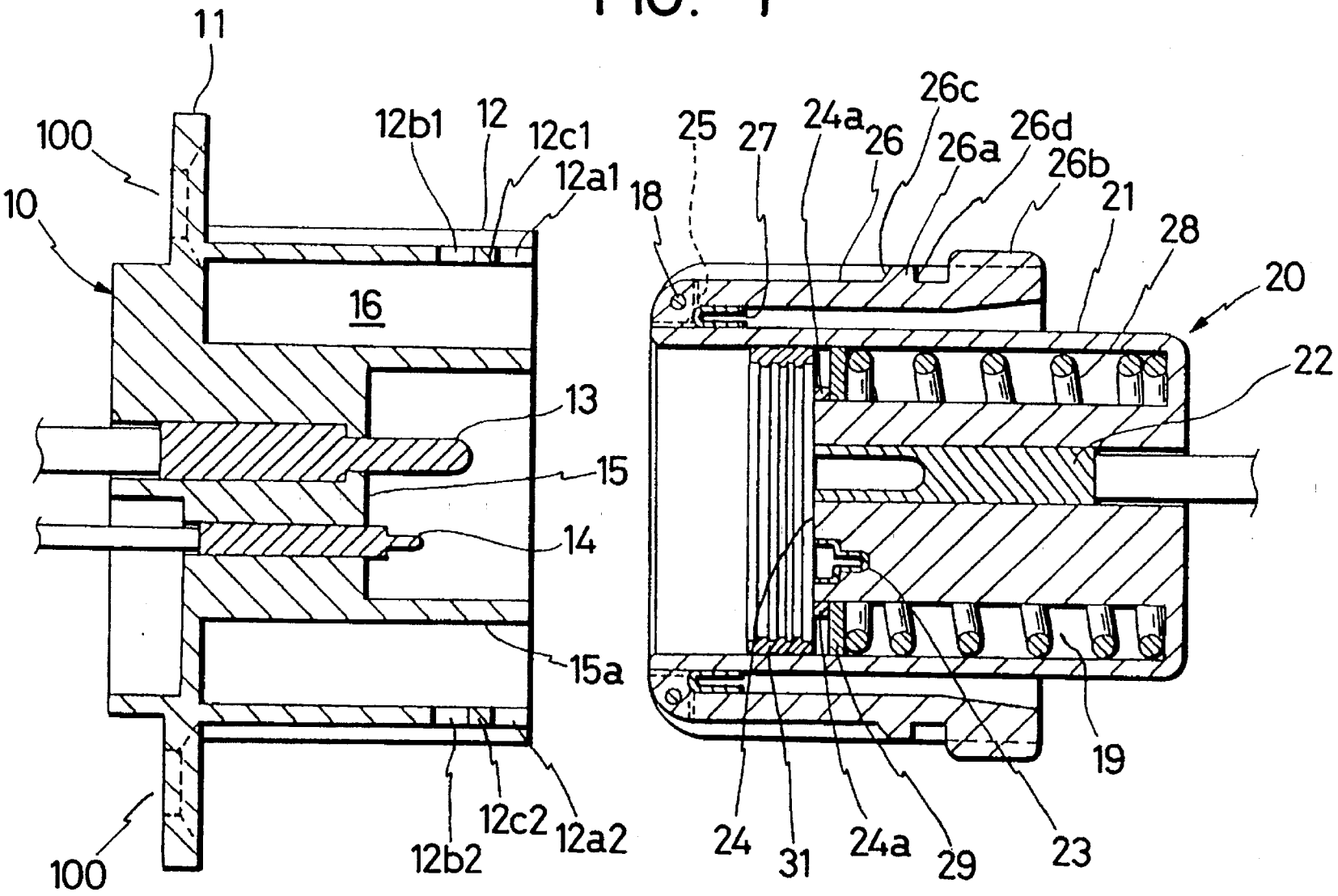
FIG. 1 is a vertical cross-sectional view of one preferred embodiment of a connector of the present invention before the fitting is effected.
Figure 2:
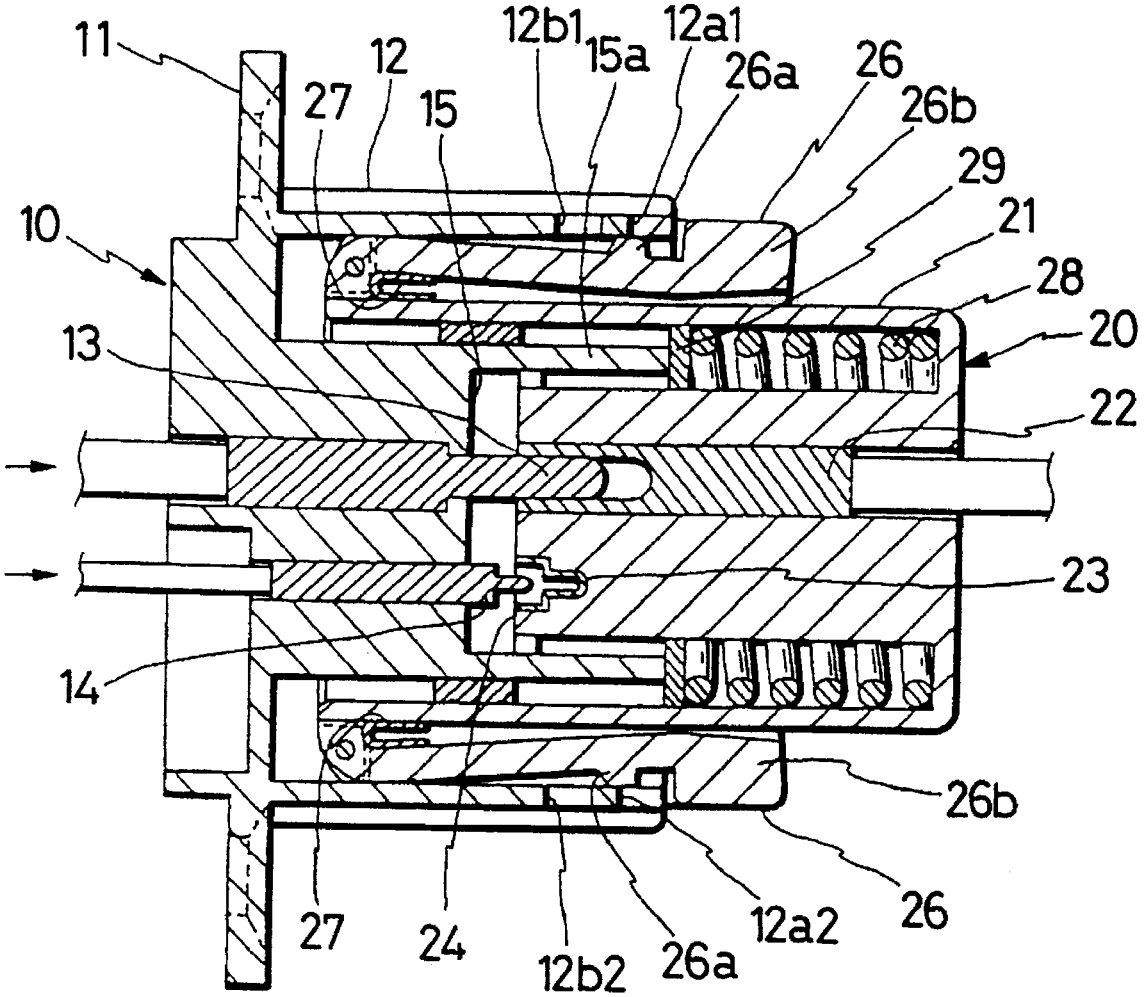
FIG. 2 is a vertical cross-sectional view of the connector during the fitting operation.
Figure 3:
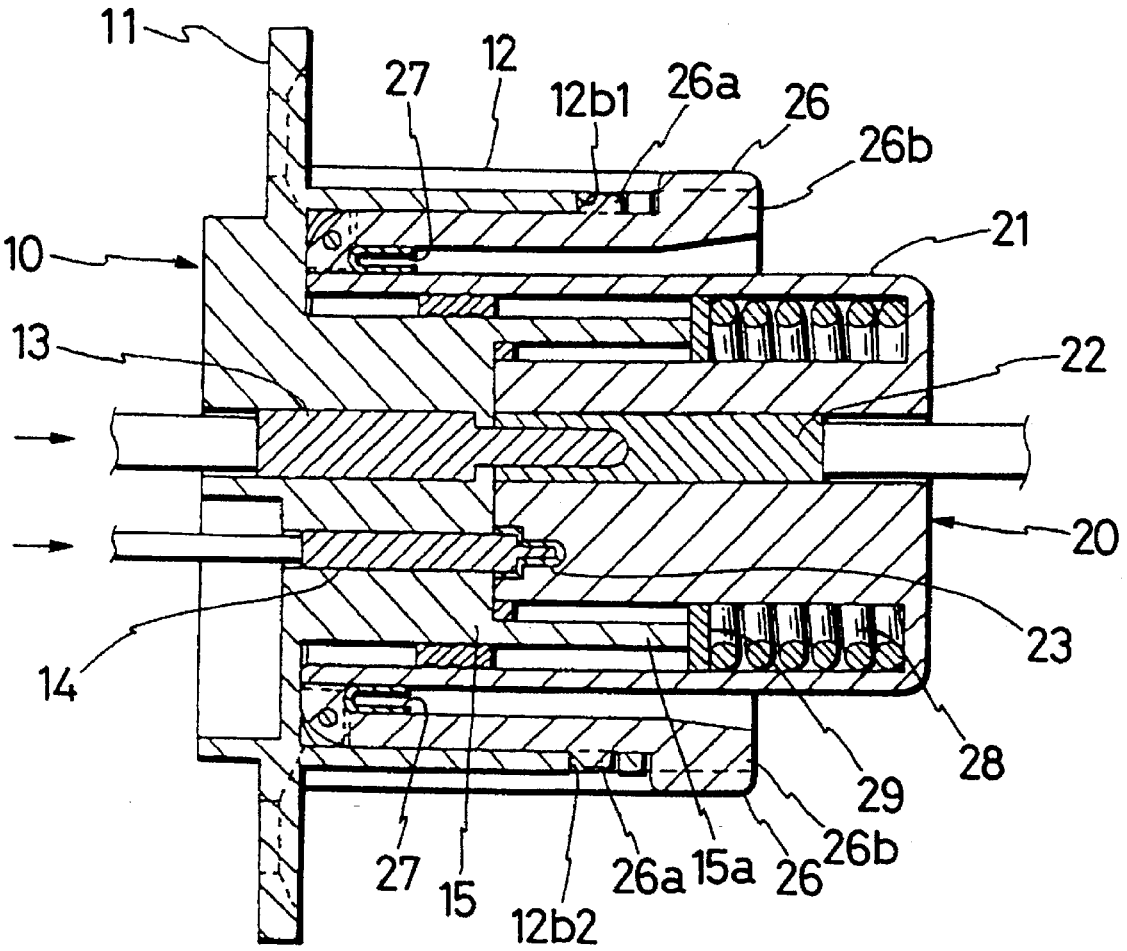
FIG. 3 is a vertical cross-sectional view of the connector in a fitted condition.
Figure 4:
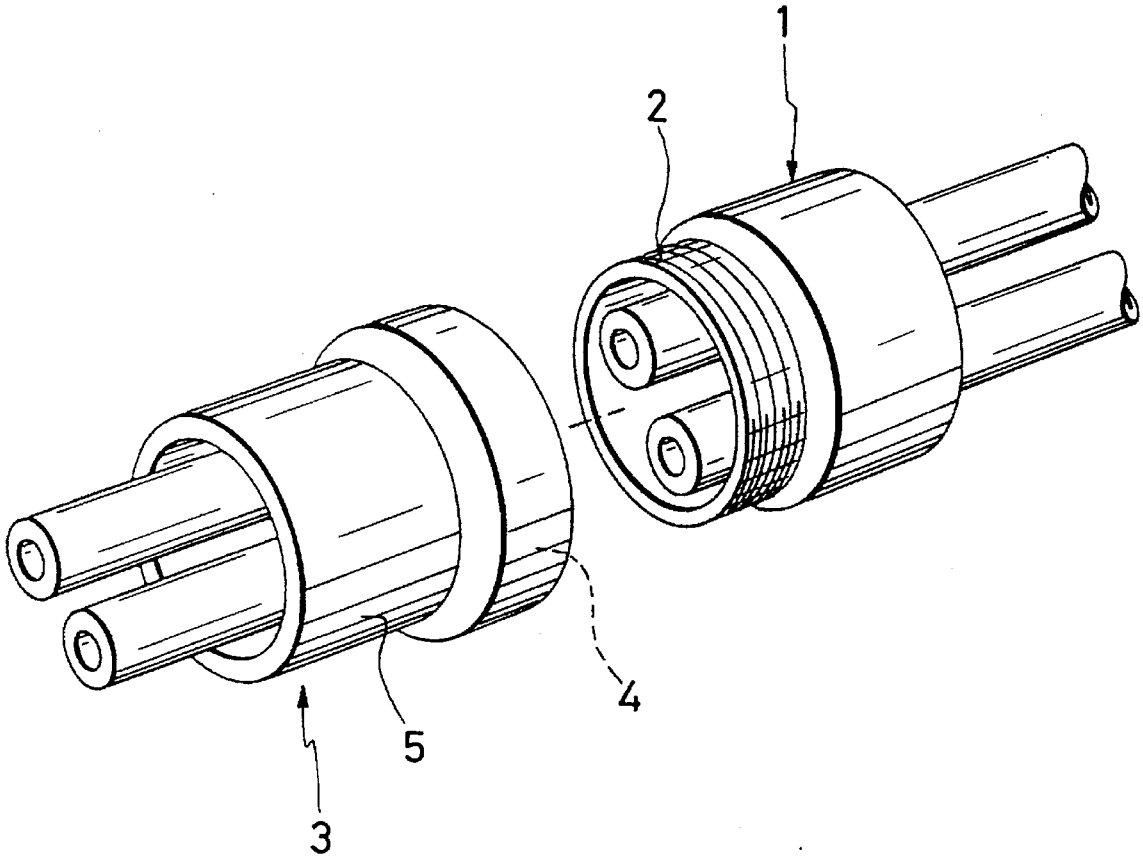
FIG. 4 RELATED ART
FIG. 4 is a perspective view of a conventional connector.

FIGS. 1–3 show the sequential operation of the connector mechanism, wherein FIG. 1 is a vertical cross-sectional view of one preferred embodiment of a connector mechanism of the present invention before engagement of the connector parts, FIG. 2 is a vertical cross-sectional view of the connector mechanism during the fitting operation, and FIG. 3 is a vertical cross-sectional view of the connector mechanism in a fitted condition.

In the drawings, the car body-side connector 10 includes a square mounting plate 11 having bolt insertion holes 100 formed respectively through four corners thereof, and a tubular hood portion 12 formed on and projecting from a front face of the mounting plate. Notches **12*a*1 and 12*a*2 are formed respectively in upper and lower portions of the hood portion 12 and extend from and are located near an open end of the hood portion. The hood portion 12 has retaining holes 12*b*1 and 12*b*2 spaced respectively from the notches 12*a*1 and 12*a*2 in an inserting direction. A terminal support base 15 is formed within the hood portion 12 and is directed toward the open end of the hood portion. A power terminal 13 and a signal terminal 14 are supported by and project from the terminal support base 15. A tubular portion serving as an abutment rib 15*a* extends from a peripheral edge portion of the terminal support base 15**.

The charger-side connector 20 includes a hood portion 21 insertable into an annular space 16 between the hood portion 12 and the terminal support base 15 of the car body-side connector 10 and a terminal support base 24 that is formed within the hood portion 21 and can be inserted into the abutment rib **15*a* of the terminal support base 15. A tubular power terminal 22 and a tubular signal terminal 23 are supported by the terminal support base 24 and are respectively fitted on and connected to the power terminal 13 and the signal terminal 14, supported by the terminal support base 15**, in a proper fitted position.

A pair of opposed ribs 25 are formed on an outer peripheral surface of each of upper and lower portions of the hood portion 21 at a front end portion thereof. A lock arm 26 toward the rear end of the charger-side connector 20 is mounted at its front end between the pair of ribs 25 for pivotal movement about pivot pin 18. Formed on the outer surface of each lock arm 26 is a retaining projection 26a, having a trapezoidal cross-section, which is retainingly engageable in the retaining hole **12*b*1 (12*b*2). A thumb tab 26*b* is formed on the outer surface of the rear end of the lock arm 26 in a bulged manner. A leaf spring 27 of a U-shaped cross-section is provided between the lock arm 26 and the hood portion 21 to urge the thumb tab 26*b* of the lock arm 26 outwardly. The front surface 26*c* of the retaining projection 26*a* is slanted while the rear surface or ledge 26*d*** thereof is vertical.

An annular space 19 is formed between the hood portion 21 and the terminal support base 24, and a coil spring 28 is received in the annular space 19, and a ring-shaped abutment plate 29, corresponding in shape to an open end of annular space 19, is received in the open end and urged toward the open end by the coil spring 28. Small projections or stops **24*a* are formed on the outer peripheral surface of the terminal support base 24 and prevent the abutment plate 29 from disengagement with the base 24**.

A waterproof seal ring 31 is mounted on the inner periphery of the hood portion 21 of the charger-side connector 20 at a deepest portion thereof. The seal ring 31 is adapted to be disposed between the hood portion 21 and the outer periphery of the abutment rib 15*a* of the car body-side connector 10 so as to prevent the intrusion of water.

The operation of the embodiment of the above construction will now be described.

The open end of the hood portion 21 of the charger-side connector 20 is disposed in facing relation to the open end of the hood portion 12 of the car body-side connector 10, as shown in FIG. 1, and the charger-side connector 20 is pushed in such a manner that the hood portion 21 of the charger-side connector 20 is inserted into the annular space 16 between the hood portion 12 and the terminal support base 15 of the car body-side connector 10. During the insertion, the abutment rib 15*a* of the terminal support base 15 is brought into sliding contact with the inner peripheral surface of the waterproof seal ring 31 mounted on the inner peripheral surface of the hood portion 21 of the charger-side connector 20. When the charger-side connector is further pushed, the abutment plate 29 supported between the hood portion 21 and the terminal support base 24 is brought into engagement with the front end of the abutment rib 15*a*.

The abutment plate 29 is urged toward the open end by the coil spring 28, and when the charger-side connector 20 is pushed, the abutment rib 15*a* compresses the coil spring 28 through the abutment plate 29. When the charger-side connector 20 is pushed to a position slightly before the proper fitted position, as shown in FIG. 2, the coil spring 28 is compressed, and the power terminal 13 supported on the car body-side connector 10 begins to be inserted into the power terminal 22 supported on the charger-side connector 20. At this stage, although the fitted condition is apparently achieved, the condition of connection between the power terminal 13 and the power terminal 22 is not complete.

If the operator stops the inserting operation in such a halfway condition, the coil spring 28 urges the abutment rib 15*a* through the abutment plate 29, so that the charger-side connector 20 is pushed out, and the power terminal 22 is completely separated from the power terminal 13. This clearly indicates that the car body-side connector 10 and the charger-side connector 20 are not fitted together, and hence, the connectors are not electrically connected together. Therefore, in this embodiment, the coil spring 28 cooperates with the abutment rib 15*a* to constitute a spring mechanism for urging the two connectors away from each other.

As shown in FIG. 3, when the charger-side connector is further pushed, the retaining projection 26*a* of each lock arm 26 is received in the notch 12*a*1 (12*a*2) and is abutted against that portion of the hood portion 12 lying between the notch 12*a*1 (12*a*2) and the retaining hole 12*b*1 (12*b*2), so that the lock arm 26 supported by the ribs 25 is pivotally moved inwardly, while flexing the leaf spring 27.

The charger-side connector is further pushed until the terminal support base 24 of the charger-side connector 10 is abutted against the terminal support base 15 of the car body-side connector 10. As a result, the power terminal 13 and the power terminal 22 are completely connected together, and the signal terminal 14 and the signal terminal 23 are completely connected together, thereby achieving a proper and complete electrical connection. The retaining projections 26*a* of the lock arms 26 are brought respectively into facing relation to the retaining holes 12*b*1 and 12*b*2 in the hood portion 12 and are received respectively in the holes 12*b*1 and 12*b*2 as the lock arms 26 are urged outwardly by the respective leaf springs 27. The insertion of the retaining projections 26*a* past holding lugs 12*c*1 and 12*c*2 is facilitated by inclined wall portion 26*c*.

When the operator releases the connector after the connector is thus inserted into the proper fitted position, the coil spring 28 urges the charger-side connector 20 by its restoring force, but since the retaining projections 26*a* are retainingly received in the retaining holes 12*b*1 and 12*b*2, respectively, the charger-side connector 20 will not be withdrawn and is kept fitted in the car body-side connector 10. Therefore, in this embodiment, the lock arms 26 each having the retaining projection 26*a* cooperate with the hood portion 12, having the retaining holes 12*b*1 and 12*b*2, to constitute a lock mechanism for retaining the connectors against the bias of the spring mechanism.

Thus, during the time when the charger-side connector 20 is inserted into the car body-side connector 10, the abutment rib 15*a* compresses the coil spring 28, and therefore, if the hold is released, the two connectors 20 and 10 are moved away from each other. However, when the connector is inserted into the proper fitted position, the retaining projections 26*a* of the lock arms 26 are retainingly engaged respectively in the retaining holes 12*b*1 and 12*b*2 in the hood portion 12, and therefore, the two connectors 20 and 10 are maintained in the fitted condition against the bias of the coil spring 28 urging the abutment rib 15*a*. In the properly fitted condition, the rear surface 26*d* of the projection 26*a* is in engagement with retaining lug 12*c*1 (12*c*2) of connector portion 10. Therefore, when the connectors are deeply fitted together, they are prevented from withdrawal thereby achieving a proper electrical connection.

When it is desired to withdraw the charger-side connector 20, the thumb tabs 26*b* of the lock arms 26 are pressed inwardly. As a result, the retaining projections 26*a* are disengaged from the retaining holes 12*b*1 and 12*b*2, respectively, and the charger-side connector 20 is pushed out by the restoring force of the coil spring 28.

In the invention of the above construction, the spring mechanism urges the two connectors away from each other during the time when one connector is inserted into the other connector. Therefore, if the inserting operation is not completed or stopped in a half-inserted condition, the connectors are moved away from each other. However, when the connectors are moved close to the proper fitted position, the lock mechanism retains the connectors against the action of the spring mechanism. Therefore, even if the hold is released, the connectors are maintained in the fitted condition.

As described above, in the present invention, the connectors are separated from each other unless they are moved close to the proper fitted position. Therefore, a connector mechanism is provided in which the connectors cannot be maintained in a half-connected condition, thereby enabling a clear and visible indication of a proper electrical connection.

While the embodiment disclosed herein is preferred, it will be appreciated from this teaching that various alternatives, modifications, variations or improvements therein may be made by those skilled in the art that are within the scope of the invention, which is defined by the following claims.

What is claimed is:

1. A connector mechanism for maintaining and indicating a proper connection comprising:

a first connector portion including a first wall and a second wall, said first wall and said second wall being spaced in predetermined relation to define an annular space therebetween, said first wall including at least one retaining hole, at least one retaining lug, and at least one notch, said second wall including at least one abutment rib; and a second connector portion having a spring mechanism and a locking assembly, said locking assembly including a locking arm having at least one retaining projection adapted to cooperate with said at least one retaining hole and at least one flexible tab engageable with said at least one notch;

wherein, during assembly of the first connector portion and the second connector portion, said spring mechanism engages said abutment rib of said second wall thereby compressing said spring mechanism, and said locking assembly is inserted within the annular space of the first connector portion;

wherein a complete connection position is achieved when the at least one retaining projection engages said at least one retaining hole, the spring mechanism being in a locked state in said complete connection position, and wherein an incomplete connection position is achieved if the at least one retaining projection and the at least one retaining hole are not engaged, the spring mechanism urging said first connector portion apart from said second connector portion in said incomplete connection position.

2. The connector mechanism according to claim 1, wherein said spring mechanism includes a spring and an abutment plate, said abutment plate engageable with said abutment rib of said first connector portion.

3. The connector mechanism according to claim 2, wherein said abutment plate is slidingly supported by a base and said spring is a coil spring having a shape complimentary to said base, said base including a stop for limiting sliding movement of said abutment plate with respect to said base.

4. The connector mechanism according to claim 3, further including a seal coupled to said second connector portion and adjacent said spring mechanism and said base.

5. The connector mechanism according to claim 3, wherein said second connector portion includes a hood, said hood being spaced from said base to thereby define a second annular space.

6. The connector mechanism according to claim 5, wherein said spring mechanism is housed within said second space.

7. The connector mechanism according to claim 5, wherein said locking arm is flexibly mounted to said hood and is spaced from said hood to define a third annular space.

8. The connector mechanism according to claim 7, further comprising a spring mounted between said hood and said locking arm, said spring urging said at least one projection into engagement with said at least one retaining hole in said complete connection position.

9. The connector mechanism according to claim 8, wherein said at least one flexible tab is depressable against the spring to allow separation between the first connector portion and the second connector portion.

10. The connector mechanism according to claim 1, wherein said at least one retaining projection includes an inclined edge and a ledge, said inclined edge facilitating sliding between the at least one retaining projection and the at least one retaining lug, said ledge maintaining the spring mechanism in a compressed state in said complete connection position, thereby preventing movement between the first connector portion and the second connector portion.

11. The connector mechanism according to claim 10, wherein said at least one retaining projecting includes a trapezoidal shape.

12. The connector mechanism according to claim 2, wherein said first wall and said second wall are mounted to a mounting plate.

13. The connector mechanism according to claim 12, wherein said mounting plate includes a base, said abutment rib being fixed to said base.

14. The connector according to claim 13, wherein said base includes a power terminal and a signal terminal that cooperate with a power terminal receiver and a signal terminal receiver in said second connector portion.

15. A connector comprising:

a first connector portion having a plate, a first hood coupled to said plate, a first base coupled to said plate, and an abutment coupled to said first base, and a second connector portion engageable with said first connector portion, said second connector portion having a second base mounting a spring mechanism that is engageable with said abutment, and a flexible locking member engageable with the first hood, said spring mechanism being stably compressed when said first hood and said flexible locking member are engaged and urging said first and second portions apart when said first hood and said flexible locking member are not engaged, at least a portion of the flexible locking member being positioned between the abutment and the first hood when the first hood and the flexible locking member are engaged.

16. The connector according to claim 15, wherein said abutment and said first hood define a first annular space and said second base and a second hood define a second annular space, wherein said spring mechanism is housed within the second annular space, said flexible locking member enters said first annular space and said abutment enters said second annular space when the first connector portion and the second connector portion are engaged, and said abutment occupies a portion of the second annular space otherwise occupied by said spring mechanism when uncompressed.

17. The connector according to claim 16, wherein said flexible locking member includes a locking arm having a retaining projection and a flexible tab, said first hood includes a retaining hole and a notch, wherein said retaining projection and said retaining hole, and said flexible tab and said notch are aligned and are engaged when the abutment compresses the spring mechanism a predetermined amount.

18. The connector according to claim 17, wherein when said spring is compressed by an amount less than said predetermined amount, said spring mechanism indicates an incomplete connection by forcing the first connector portion and the second connector portion to separate.

* * * * *